US006910849B2

(12) United States Patent
Bertuzzi et al.

(10) Patent No.: US 6,910,849 B2
(45) Date of Patent: Jun. 28, 2005

(54) METHOD AND DEVICE FOR TURNING OVER STACKS OF PRODUCTS ON A CARTONING MACHINE

(75) Inventors: Ivanoe Bertuzzi, Via Sandro Pertini (IT); Alver Tacchi, Via Vittoria (IT); Simone Scagliarini, Via Marmo (IT); Fiorenzo Draghetti, Via San Domino (IT)

(73) Assignee: G.D. Societa' per Azioni, Bologna (IT)

( * ) Notice: Subject to any disclaimer, the term of this patent is extended or adjusted under 35 U.S.C. 154(b) by 37 days.

(21) Appl. No.: 10/422,748

(22) Filed: Apr. 25, 2003

(65) Prior Publication Data

US 2004/0020167 A1 Feb. 5, 2004

(30) Foreign Application Priority Data

May 3, 2002 (IT) ..... BO2002A0258

(51) Int. Cl.[7] ..... B25J 1/133

(52) U.S. Cl. ..... 414/778; 414/789.2

(58) Field of Search ..... 53/542, 543, 566; 414/778, 789.2

(56) References Cited

U.S. PATENT DOCUMENTS

| | | | | |
|---|---|---|---|---|
| 3,022,615 A | * | 2/1962 | Schroeder et al. | 53/458 |
| 3,566,574 A | | 3/1971 | Salwasser | |
| 4,517,791 A | | 5/1985 | Focke | 53/566 |

* cited by examiner

*Primary Examiner*—Khoi H. Tran
(74) *Attorney, Agent, or Firm*—Harness, Dickey & Pierce

(57) ABSTRACT

A method and device for turning over stacks of products on a cartoning machine, whereby a group of products, arranged in at least one stack, is fed into a container, from which the group is expelled by a push device after the container is rotated 90° about an axis from a loading position to a turned-over unloading position; the container has a first and a second passage enabling the push device to move through the container when the container is in the turned-over unloading position and the loading position respectively.

16 Claims, 2 Drawing Sheets

METHOD AND DEVICE FOR TURNING OVER STACKS OF PRODUCTS ON A CARTONING MACHINE

The present invention relates to a method of turning over stacks of products on a cartoning machine, i.e. a machine for conditioning one or more stacks of products in a single wrapping.

The present invention, which can be used for conditioning any type of "stackable" product, is particularly advantageous for use on machines for cartoning packets of cigarettes, to which the following description refers purely by way of example.

BACKGROUND OF THE INVENTION

In the tobacco industry, a cartoning machine is supplied with a succession of packets of cigarettes, which are laid flat one on top of the other to form a succession of stacks, each comprising a given number of packets. The stacks are formed into orderly groups, each of which comprises a given number of side by side stacks, and forms the content of a carton obtained by means of a packaging operation wherein a sheet or blank of packaging material is folded about the relative group. Prior to performing the packaging operation, it is often necessary or convenient to turn the stacks over through 90° so that the packets in the groups are positioned on edge.

SUMMARY OF THE INVENTION

It is an object of the present invention to provide a method of turning over stacks of products, which is straightforward and easy to implement.

It is a further object of the present invention to provide a method of turning over stacks of products, which provides for minimizing downtime.

According to the present invention, there is provided a method of turning over stacks of products on a cartoning machine, as claimed in Claim 1 and, preferably, in any one of the Claims depending directly and/or indirectly on Claim 1.

The present invention also relates to a device for turning over stacks of products on a cartoning machine.

According to the present invention, there is also provided a device for turning over stacks of products on a cartoning machine, as claimed in Claim 9 and, preferably, in any one of the Claims depending directly and/or indirectly on Claim 9.

BRIEF DESCRIPTION OF THE DRAWINGS

A non-limiting embodiment of the invention will be described by way of example with reference to the accompanying drawings, in which.

DETAILED DESCRIPTION OF THE INVENTION

Figure 1:
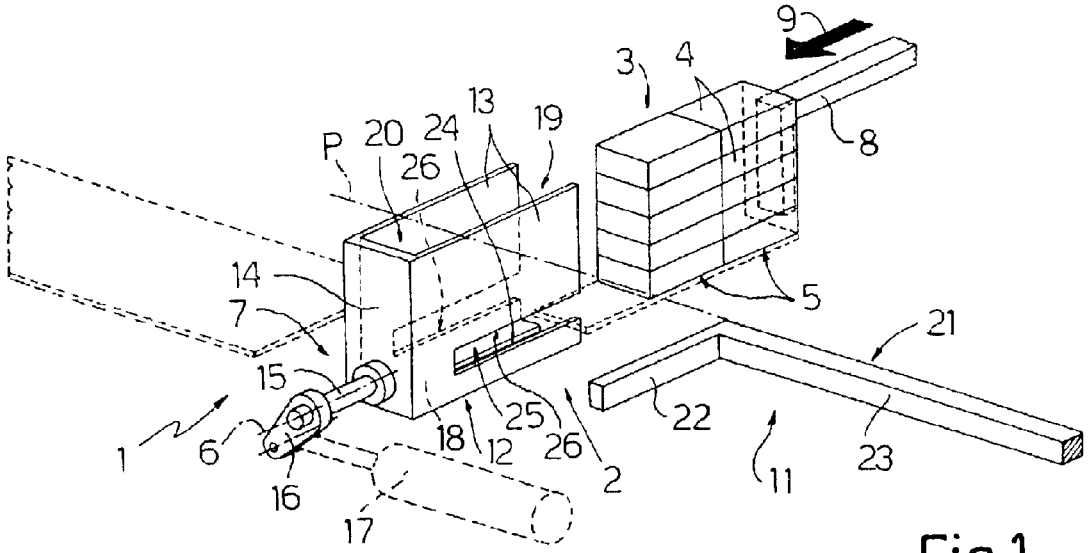
FIGS. 1 to 6 show schematic views in perspective, with parts removed for clarity, of a preferred embodiment of the turnover device according to the present invention in respective different operating positions.

Number 1 in the accompanying drawings indicates as a whole a cigarette cartoning machine comprising a turnover device 2 for turning over groups 3 of packets 4 of cigarettes arranged in stacks 5. In the example shown, turnover device 2 provides for turning over, through 90° and about a substantially horizontal axis 6, a succession of groups 3, each of which is originally defined by two side by side stacks 5 of five packets, in which packets 4 are laid flat horizontally.

Turnover device 2 comprises a turnover station 7, to which groups 3 are fed, in their original configuration and by means of a push device 8, in a horizontal direction 9 parallel to axis 6, and from which groups 3 are expelled, in a second substantially horizontal direction 10 perpendicular to axis 6, and by means of a further push device 11, in a configuration turned over through 90°, and in which packets 4 are positioned on edge.

Turnover station 7 is defined by a box 12 in the form of a rectangular prism and sized to accommodate one group 3. More specifically, box 12 comprises two major lateral walls 13 parallel to each other and to axis 6, and which are connected, at a lateral end opposite that facing push device 8, by a minor lateral wall 14, to the outer surface of which is connected integrally a shaft 15 coaxial with axis 6 and fitted with a crank 16 connected to the output of an actuating device 17 for oscillating box 12, by 90° about axis 6, between a loading position, in which major lateral walls 13 are positioned vertically, and a turned-over unloading position, in which major lateral walls 13 are positioned horizontally.

The ends of the two major lateral walls 13 located at the bottom when major lateral walls 13 are positioned vertically, are connected by a bottom wall 18, and the ends of major lateral walls 13 opposite minor lateral wall 14 and opposite bottom wall 18 define respective openings 19 and 20 for the passage of group 3 in direction 9 and direction 10 respectively.

Push device 11 comprises an L-shaped push member 21, in turn comprising a push arm 22 parallel to axis 6 and movable through turnover station 7 and box 12, and an actuating arm 23 parallel to direction 10 and movable back and forth along a path P parallel to direction 10 and extending outside the end of box 12 facing push device 8.

For push arm 22 to move through box 12, box 12 is provided with two passages 24 and 25; passage 24 is formed through bottom wall 18, and is defined by a slot parallel to axis 6 and communicating with opening 19 at the end facing push device 8; and passage 25 is defined by two slots 26 formed, facing each other, through major lateral walls 13 and aligned with direction 10 when box 12 is in the loading position with bottom wall 18 positioned horizontally. Each of slots 26 is substantially similar to the slot defining passage 24, is parallel to axis 6, and communicates with opening 19 at the end facing push device 8.

Figure 2:
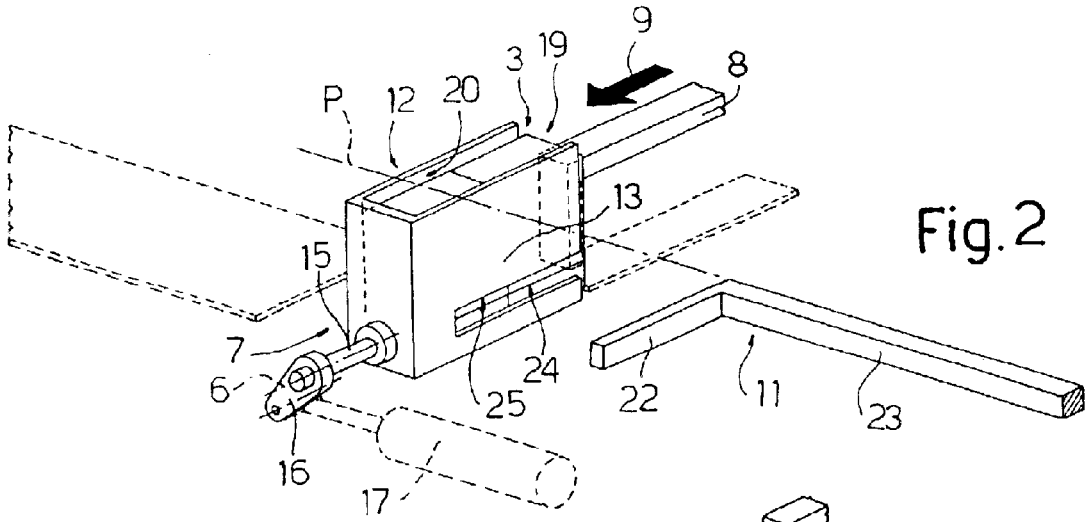
Figure 3:
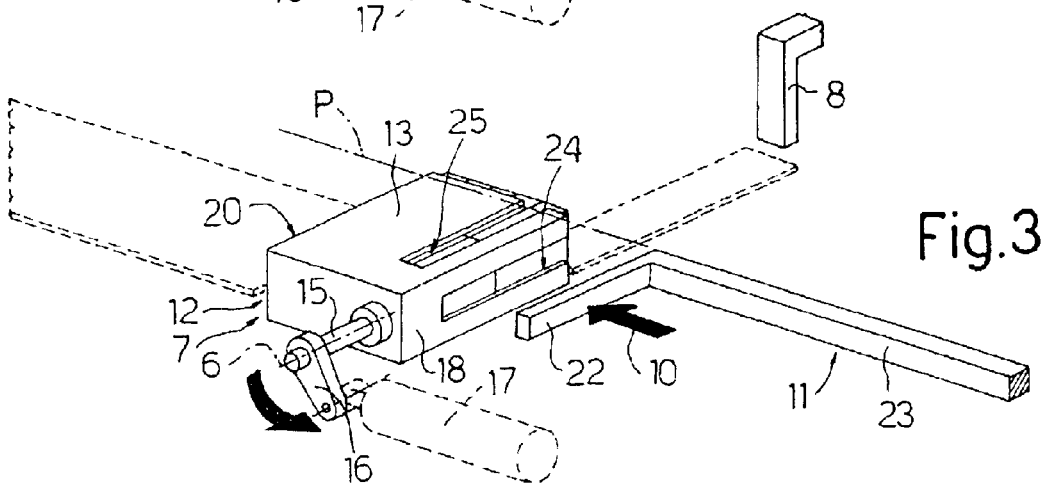
Figure 4:
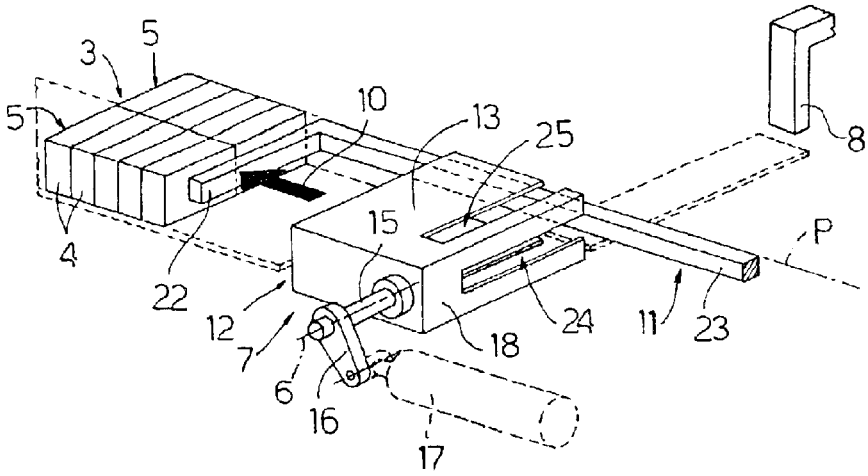

In actual use, box 12, which is initially empty, is set to a loading position with opening 20 facing upwards (FIG. 1), and receives a group 3 (FIG. 2), the packets 4 of which are laid flat, and which is pushed by push device 8 into box 12 through opening 19 in direction 9. At this point, actuating device 17 is operated to turn box 12 (FIG. 3) over through 90° (anticlockwise in the drawings), so that packets 4 are positioned on edge, bottom wall 18 is positioned vertically, and opening 20 faces in direction 10; and push member 21 of push device 11 (FIG. 4) is moved in direction 10 from a rest position outside box 12, so that push arm 22 engages the passage 24 slot and pushes group 3 out of box 12 through opening 20 in direction 10.

Figure 5:
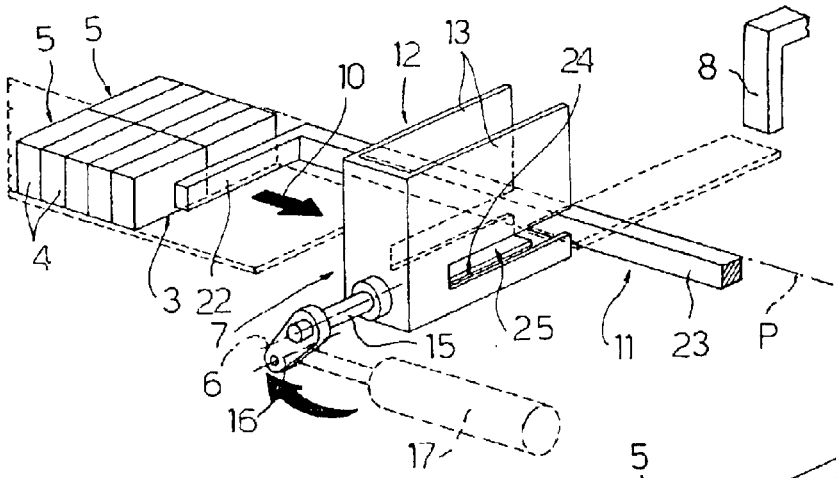
Figure 6:
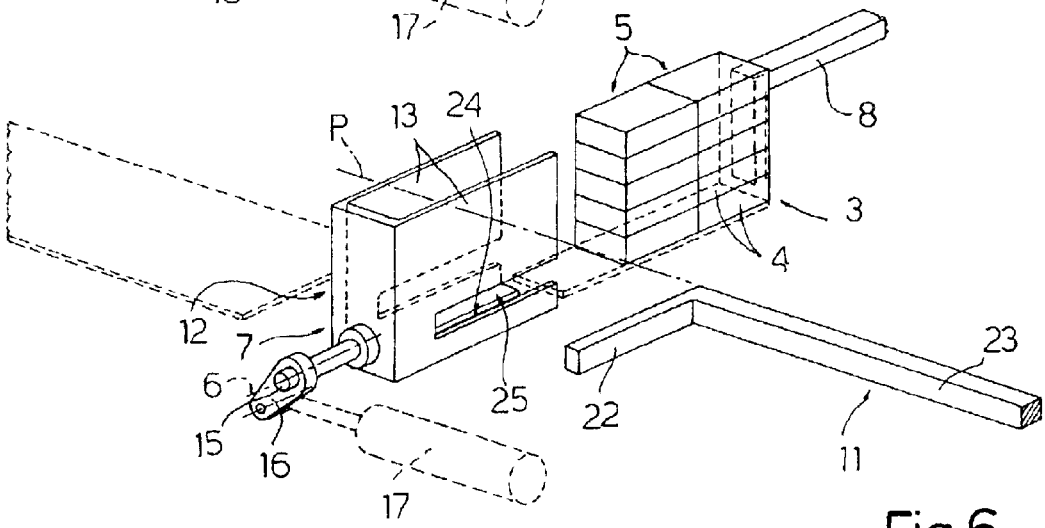

When push arm 22 comes out of box 12 in direction 10, box 12, which is completely free (on account of actuating arm 23 extending alongside the outside of box 12), can be restored (FIG. 5) to the initial loading position to receive the next group 3. And only at this point is push arm 22 (FIG. 6) withdrawn through slots 26 of passage 25 back into the initial rest position.

As will be clear from the above description, if passage 25 were not provided, box 12 could only be rotated back into the loading position after push arm 22 is withdrawn, and not, as described, as push arm 22 completes the forward movement and begins the return movement, thus greatly increasing the downtime involved.

What is claimed is:

1. A method of turning over stacks of products on a cartoning machine, the method comprising:

feeding a group of products arranged in at least one stack to a turnover station;

feeding the group of products into a container at the turnover station;

turning over the container about an axis and from a first position to a second position turned 90° with respect to said first position so as to turned over through 90° the group;

moving a push device from a rest position to a feeding position and through a first passage of the container so as to bring the push device into contact with the turned-over group and to expel the turned-over group from the container;

turning over the empty container about the axis and from the second position to the first position while the push device is in the feeding position; and moving the push device from the feeding position to the rest position and through a second passage of the container perpendicular to the first passage when the container is in the first position.

2. A method as claimed in claim 1, wherein said group is fed into said container in a first direction and when the container is in said first position, and said group is expelled from said container in a second direction and when the container is in said second position; the container having a first opening facing the first direction and for the passage of said group, and a second opening for the passage of said group and facing said first passage and said second direction when the container is in said second position; said push device moving through said container from the rest position outside said container, engaging said first passage and said second opening while moving from the rest to the feeding position, and engaging, while moving from the feeding to the rest position, said second passage, which is formed in said container in a position which is aligned with said second direction when the container is in said first position.

3. A method as claimed in claim 2, wherein expelling the turned-over group comprises moving said container into said second position;

moving said push device from the rest to the feeding position through and beyond said container in said second direction by engaging said first passage and then said second opening;

rotating said container about said axis into said first position; and moving said push device from the feeding to the rest position to restore the push device to said rest position by engaging said second passage.

4. A method as claimed in claim 2, wherein said container comprises a number of walls; said second passage comprising two slots facing each other and formed in two respective said walls facing each other and crosswise to said second direction when the container is in said first position.

5. A method as claimed in claim 2, wherein said axis is parallel to said first direction.

6. A method as claimed in claim 2, wherein said first and said second direction are perpendicular.

7. A method as claimed in claim 2, wherein said first and said second direction are both horizontal.

8. A method as claimed in claim 2, wherein said first and said second passage communicate laterally with said first opening; and said push device includes an L-shaped push member, further including a push arm movable through said first and said second passage and extending crosswise to said second direction, and an actuating arm parallel to said second direction and movable, moving from the feeding to the rest position and moving from the rest to the feeding position, along a path parallel to said second direction and outside said container.

9. A device for turning over stacks of products on a cartoning machine, the device comprising:

a turnover station adapted to turn over, through 90° and about an axis, at least one group of products arranged in at least one stack;

a feeder adapted to feed said group to said turnover station in a first direction;

a container at the turnover station adapted to receive at least one said group and having a first passage and a second passage, which is perpendicular to the first passage;

a turning device adapted to turn over the container about said axis between a first position and a second position turned 90° with respect to said first position about the axis;

a push device by which said group turned over at said turnover station is expelled in a second direction; and a drive device for moving the push device from a rest position to a feeding position through the first passage of the container when the container is in the second position, and for returning the push device from the feeding position to the rest position through the second passage of the container when the container is in the first position.

10. A device as claimed in claim 9, wherein said feeder is movable in a first direction, and said push device is movable in a second direction; the container having a first opening facing the first direction and for the passage of said group, and a second opening for the passage of said group and facing said first passage and said second direction when the container is in said second position; and said push device moving through said container from a rest position outside said container, engaging said first passage and said second opening while moving from the rest to the feeding position, and engaging, while moving from the feeding to the rest position, said second passage, which is formed in said container in a position which is aligned with said second direction when the container is in said first position.

11. A device as claimed in claim 10, wherein said container comprises a number of walls; said second passage comprising two slots facing each other and formed in two respective said walls facing each other and crosswise to said second direction when the container is in said first position.

12. A device as claimed in claim 10, wherein said container is a box in the form of a rectangular prism, and having two first lateral walls parallel to said first direction; a second lateral wall perpendicular to said first lateral walls and facing said first opening; and an end wall facing said second opening; said first passage being formed through said end wall, and said second passage comprising two slots, each formed in a respective said first lateral wall.

13. A device as claimed in claim 10, wherein said axis is parallel to said first direction.

14. A device as claimed in claim 10, wherein said first and said second direction are perpendicular.

15. A device as claimed in claim 10, wherein said first and said second direction are both horizontal.

16. A device as claimed in claim 10, wherein said first and said second passage communicate laterally with said first opening; and said push device including an L-shaped push member, which further includes a push arm movable through said first and said second passage and extending crosswise to said second direction, and an actuating arm parallel to said second direction and movable, while moving from the rest to the feeding position and from the feeding to the rest position, along a path parallel to said second direction and outside said container.

* * * * *

UNITED STATES PATENT AND TRADEMARK OFFICE

CERTIFICATE OF CORRECTION

PATENT NO. : 6,910,849 B2
DATED : June 28, 2005
INVENTOR(S) : Bertuzzi et al.

It is certified that error appears in the above-identified patent and that said Letters Patent is hereby corrected as shown below:

Title page,
Item [75], Inventors, should read:
-- Ivanoe Bertuzzi, Casalecchio Di Reno (IT); Alver Tacchi, Bologna (IT); Simone Scagliarini, San Giovanni in Persiceto (IT); Fiorenzo Draghetti, Medicina (IT) --.
Item [73], Assignee, delete and add -- G.D Societa' per Azioni, Bologna (IT) --.

Signed and Sealed this

Twenty-first Day of March, 2006

JON W. DUDAS
*Director of the United States Patent and Trademark Office*